US008594844B1

(12) United States Patent
Gal

(10) Patent No.: US 8,594,844 B1
(45) Date of Patent: Nov. 26, 2013

(54) SINGLE OPERATOR MULTITASK ROBOTIC PLATFORM

(75) Inventor: Ehud Gal, Reut (IL)

(73) Assignee: Defense Vision Ltd, Reut (IL)

( * ) Notice: Subject to any disclaimer, the term of this patent is extended or adjusted under 35 U.S.C. 154(b) by 439 days.

(21) Appl. No.: 13/022,661

(22) Filed: Feb. 8, 2011

Related U.S. Application Data

(60) Provisional application No. 61/302,558, filed on Feb. 9, 2010.

(51) Int. Cl.
*G05B 19/04* (2006.01)
*G06F 19/00* (2011.01)

(52) U.S. Cl.
USPC ..... 700/246; 700/245; 700/258; 700/259

(58) Field of Classification Search
USPC ..... 700/264, 245, 258, 259; 600/407, 427, 600/429; 342/191, 25 A, 25 R, 57, 60; 318/568.16
See application file for complete search history.

(56) References Cited

U.S. PATENT DOCUMENTS

| | | | | |
|---|---|---|---|---|
| 7,363,994 | B1 | 4/2008 | DeFazio | |
| 2004/0168837 | A1 | 9/2004 | Michaud | |
| 2008/0277172 | A1 | 11/2008 | Ben-Tzvi | |
| 2008/0294288 | A1 * | 11/2008 | Yamauchi | 700/258 |
| 2009/0211823 | A1 * | 8/2009 | Shraga et al. | 180/9.42 |
| 2009/0314554 | A1 * | 12/2009 | Couture et al. | 180/8.7 |
| 2011/0031044 | A1 | 2/2011 | Gal | |

* cited by examiner

*Primary Examiner* — Ian Jen
(74) *Attorney, Agent, or Firm* — Steven C. Lessoff

(57) ABSTRACT

A robotic platform is capable of multi-tasking under control of a single remote operator. The platform may include a turret mounted on a positioning mechanism. The turret may incorporate an imaging sensor, a target designator and a weapon in a synchronized manner. The robotic platform is capable of switching between different modes: (i) an engaged mode, in which the turret is aligned with the preferred direction of travel of the platform; in the engaged mode the turret is designated by maneuvering the entire robotic platform; (ii) a disengaged mode, in which the robotic platform faces in a first direction while the turret faces another direction to acquired targets. Various functions of driving the platform and operating the turret may be automated to facilitate control by a single operator.

25 Claims, 9 Drawing Sheets

SINGLE OPERATOR MULTITASK ROBOTIC PLATFORM

This patent application claims the benefit of U.S. Provisional Patent Application No. 61/302,558 filed 9 Feb. 2010.

FIELD AND BACKGROUND OF THE INVENTION

The present invention is related to the field of robotics; more specifically the invention is related to the field of electro-mechanics for providing a robotic platform including enhanced operational capabilities for performing multiple tasks simultaneously under the control of a single human operator.

The art of robotics has increasingly developed throughout the years, many solutions have been offered by the art in order to overcome the various challenges inherent in the robotics field.

The solutions offered by the art are usually customized to the requirements for which a robotic platform is designed.

Robotic platforms are utilized for various operations such as reconnaissance and dismantling bombs. Armed robots even participate in actual warfare at the operational scene. Robots also participate in search and rescue missions, securing perimeters and facilities, scattering violent demonstrations, preventing terror activities, rescuing hostages, military applications etc. Robots are therefore increasingly involved in operational tasks in order to assist the operating forces and to minimize the exposure of soldiers to threats that lure them into hostile environments.

A basic task which is inherent to most operations is the gathering of information from the operational scene. This information is utilized for advanced planning by operating units. Such information may increase the situational awareness of the operating units in the field, thus improving their performance and their ability to respond to the unexpected events which may occur during combat. Information gathering is therefore a task which is vital prior to operations as well as during operations in order to assist soldiers in the field and to improve the decision making capabilities of commanders at the headquarters.

Another important task vital to military forces is that of an advance guard. Such a guard must uncover and engage threats before they reach concentrated forces and vulnerable units. K9 units are often used for this job. Amongst other limitations, K9 units can only recognize certain kinds of threats, K9 units can only engage relatively soft threats, K9 units cannot protect mechanized units traveling at high speeds and K9 units cannot return precise information about a scene ahead of the force. It would therefore be preferable to employ robotic platforms to perform as an advance guard instead of endangering the K9 units.

There are a variety of robotic platforms which are capable of gathering information from the field. However, because such platforms play a vital part in operations, they are also prone to be targeted by the enemy. There exists a need for a platform which is capable of gathering information in a relatively discreet manner and also capable of retaliating quickly when attacked. Such a platform needs to be relatively simple to manufacture in order to allow for redundancy during combat and to replace human soldiers as much as possible during combat and reconnaissance.

Another major challenge which is well known in the art of robotics is the ability to effectively drive a robotic platform, especially under chaotic operational conditions. Copending U.S. patent application Ser. No. 12/844,884 to Gal describes some of the difficulties which are associated with such a challenge. In general, Gal '884 addresses that challenge by providing a robotic platform which unifies the maneuvering man machine interface with the interface for the operational means (e.g. weapons and target designators). This facilitates simultaneous control of the operational means and locomotion of the platform by a remote operator; this capability is named there—the Three-Factor Dynamic Synchronization capability (the three factors including sensors, weapons and target designators). Three-Factor Dynamic Synchronization simplifies the operator's job by assuring that sensors, target designators and weapons are all aligned in a single direction.

During operations a robotic platform may be required to face or to travel in one direction and to activate operational means or to gather information from another direction. For example, the platform may be driven along a path while acquiring information or activating operational means towards regions of interest which surround the path. Providing means to operate various factors in different directions will be referred to herein as the "disengagement challenge."

Even when physical means are provided for operating and driving in different directions, it is a challenging task for a single remote operator to simultaneously drive the platform in one direction while gathering information and engaging threats in other directions (hereinafter: the "control challenge"). If the control challenge is not properly addressed, the robotic platform may accidently crash and operational means may be inadvertently activated towards the wrong target.

In order to overcome the control challenge, one may employ multiple remote operators each of whom performs different tasks associated with the operation of the robotic platform, (for example, one operator may be in charge of the driving the robotic platform while another operator operates information gathering and operational means). The drawback of multiple operators is the need to double the manpower required to operate such robotic platforms and the need to synchronize both operators in order to maintain fluent operation of the platform throughout the operation.

Therefore there is a recognized need for a control interface for a robotic platform that allows a remote operator to perceive events at the operational scene and multi-task the robotic platform without endangering the surroundings.

There is further a recognized need for a robotic platform that may deploy ahead of a military force to act as an advance guard to uncover and engage threats to the main force.

There is further a recognized need for a robotic platform that may quickly counter guerilla forces which attack a military force by surprise from hidden locations. This need is especially important for heavy vehicles with an obstructed field of view such as tanks, trucks, Jeeps, D9s, etc.

Yet another recognized need in the field of security in general and homeland security and private security, in particular, is to replace manned security patrols. These patrols roam a certain area, either according to preplanned routes or at random. Such patrols monitor an area to detect potential threats and to act against such threats.

It is therefore desirable to provide a robotic platform which is capable of engagement and disengagement between the maneuvering interface and the operational interface of the platform.

It is further desirable to provide that the robotic platform operate with a flexible array of operational means to suit the requirements of different assignments.

It is further desirable to provide a robotic platform which supports stealth and unobtrusive operation.

It is further desirable to provide a robotic platform capable of traversing obstacles and capable of detecting threats and responding to threats.

It is further desirable to provide a robotic platform capable of coordinating operation with other fighting forces in a convoy.

It is further desirable to provide a relatively light weight robotic platform with a relatively simple design.

It is further desirable to provide a robotic platform which can be operated intuitively in various operational modes.

Other objects and advantages of the present invention will become apparent as the description proceeds.

SUMMARY OF THE INVENTION

Various embodiments are possible for a configurable single operator multitask robotic platform.

An embodiment of a robotic platform may include a main frame and a first imaging sensor directed in a preferred direction of travel. The robotic platform may further include synchronized factors rotatably mounted to the main frame. The synchronized factors may include a second imaging sensor, a target designator and a weapon. The platform may also include a remote control interface configured for control by a single human operator. The synchronized factors may be configured for switching between an engaged mode wherein the synchronized factors are aligned to the first imaging sensor, and a disengaged mode wherein the synchronized factors rotate independently of the first imaging sensor.

An embodiment of a robotic platform may further include a processor configured for performing a task automatically when the synchronized factors are in the disengaged mode. For example, the task performed automatically may be detecting a motion, locking on a target, tracking a target, approaching a target, warning the operator of a need for attention, driving the robotic platform (including maneuvering and navigating), overcoming an obstacle, following a target, retreating from a target, evading a threat and acting in support of a friendly combat unit.

In an embodiment of a robotic platform, the first imaging sensor may be synchronized to a second target designator and to a second weapon.

In an embodiment of a robotic platform, the first imaging sensor may be configured for reconnaissance in a preferred direction of travel of the robotic platform while the robotic platform is in said disengaged mode.

In an embodiment of a robotic platform, the synchronized factors may be configured to function while the robotic platform is being transported by a vehicle. During transport, the synchronized factors may function in the disengaged mode for supplying information on events around the vehicle or for engaging threats to the vehicle.

In an embodiment of a robotic platform, the control interface may be configured to utilize an intuitive power of the human operator. The intuitive power may include binocular depth perception, peripheral motion detection, stereo audio perception and tracking.

In an embodiment of a robotic platform, the synchronized factors may be mounted to an interchangeable modular assembly.

In an embodiment of a robotic platform, the control interface may be configured to present to the human operator an integrated image including an image captured by the first imaging sensor and another image captured by the second imaging sensor.

In an embodiment of a robotic platform, the switching between the engaged and disengaged modes may be performed automatically.

In an embodiment of a robotic platform, the switching between the engaged and disengaged modes may be performed in reaction to detecting a movement in the environment around the robotic platform, detecting an attack or detecting a sound.

In an embodiment of a robotic platform, switching from the engaged mode to the disengaged mode may include directing the synchronized factors toward a target, designating a target, or activating a weapon towards a target.

An embodiment of a robotic platform may further include a turret and the synchronized factors may be mounted to the turret.

An embodiment of a method for a single human operator to control a robotic platform having a main frame may include acquiring a first image from an imaging sensor directed in a preferred direction of travel of the robotic platform. The method may also include directing synchronized factors towards a target. The synchronized factors may include a rotationally mounted second imaging sensor, a target designator and a weapon. A remote control interface configured for control by a single human operator may be provided. The method may further include switching the synchronized factors from an engaged mode wherein the synchronized factors are aligned to the first imaging sensor to a disengaged mode wherein the synchronized factors rotate independently of the first imaging sensor.

An embodiment of a method for a single human operator to control a robotic platform may further include performing a task automatically when the synchronized factors are in the disengaged mode.

In an embodiment of a method for a single human operator to control a robotic platform, the automatically performed task may include detecting a motion, tracking a target, locking on a target, warning the operator of a need for attention, driving the robotic platform, overcoming an obstacle, following a target, approaching a target, retreating from a target, avoiding a threat and acting in support of a friendly combat unit.

An embodiment of a method for a single human operator to control a robotic platform may further include synchronizing the first imaging sensor to a second target designator and to a second weapon.

An embodiment of a method for a single human operator to control a robotic platform may further include supplying information on events occurring around a vehicle or engaging threats to a vehicle while the robotic platform is being transported by the vehicle. The supplying of information and engaging of threats may be performed using the synchronized factors in the disengaged mode.

An embodiment of a method for a single human operator to control a robotic platform may further include utilizing an intuitive power of the human operator. The intuitive power may include binocular depth perception, peripheral motion detection, tracking or stereo audio perception.

An embodiment of a method for a single human operator to control a robotic platform may further include changing a modular assembly including the synchronized factors.

An embodiment of a method for a single human operator to control a robotic platform may further include presenting to the human operator an integrated image including an image captured by the first imaging sensor and another image captured by the second imaging sensor.

In an embodiment of a method for a single human operator to control a robotic platform, the switching from the engaged mode to the disengaged mode may be performed automatically. The switching may be performed in reaction to detecting a movement in the vicinity of the robotic platform, detecting an attack and detecting a sound.

In an embodiment of a method for a single human operator to control a robotic platform, the switching from an engaged to a disengaged mode may include directing the synchronized factors towards a target, designating a target, and activating the weapon towards a target.

DETAILED DESCRIPTION OF THE INVENTION

For a better understanding of the invention and to show how the same may be carried into effect, reference will now be made, purely by way of example, to the accompanying drawings. With specific reference to the drawings in detail, it is stressed that the particulars shown are by way of example and for purposes of illustrative discussion of preferred embodiments of the present invention only, and are presented for the purpose of providing what is believed to be the most useful and readily understood description of the principles and conceptual aspects of the invention. In this regard, no attempt is made to show structural details of the invention in more detail than is necessary for a fundamental understanding of the invention. From the description taken together with the drawings it will be apparent to those skilled in the art how the several forms of the invention may be embodied in practice. Moreover, it is to be understood that the phraseology and terminology employed herein is for the purpose of description and should not be regarded as limiting the scope of the invention hereof.

Figure 1A:
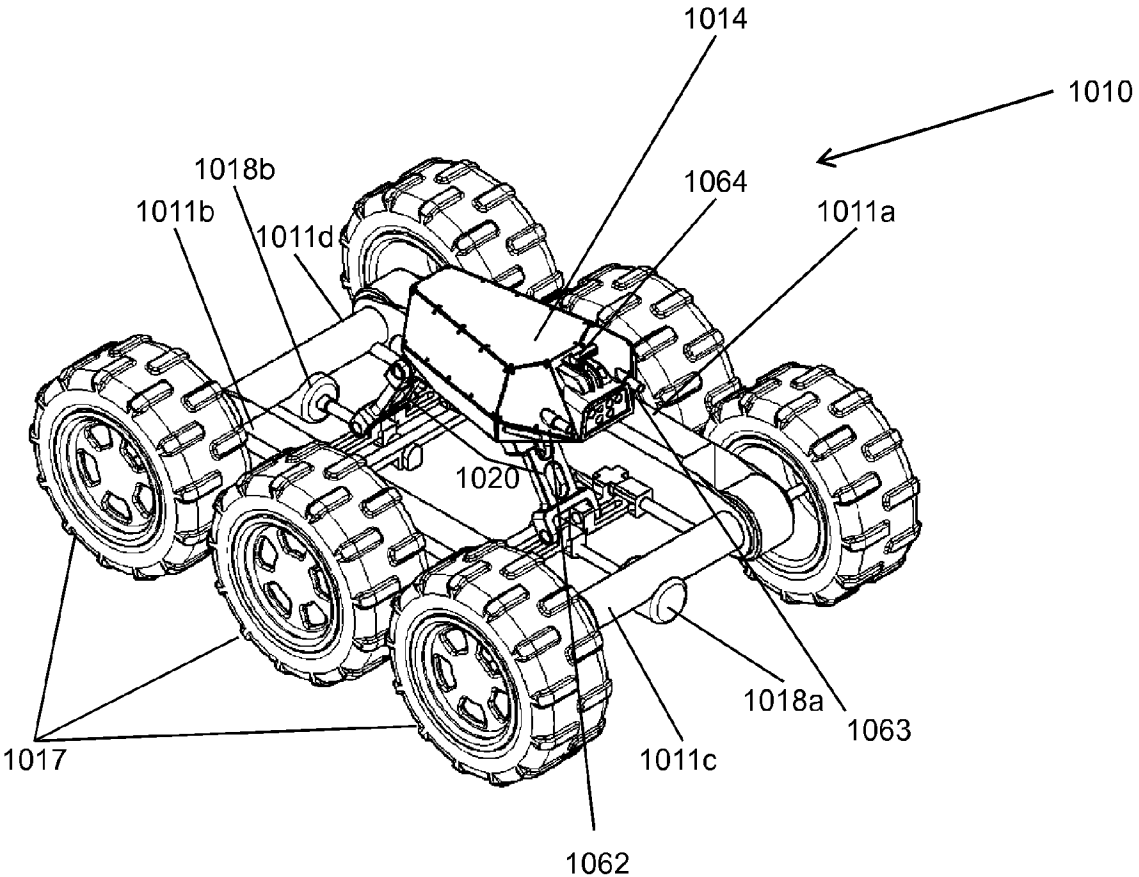
FIG. 1A schematically shows a perspective view of a preferred embodiment of the robotic platform in an engaged operational mode.

FIG. 1A schematically shows a perspective view of a preferred embodiment of a robotic platform 1010 in an operational mode. Platform 1010 includes two elongated longitudinal beams 1011*a* and 1011*b* on the left and right side of the platform 1010 respectively, and two lateral beams 1011*c* and 1011*d* in the front and the back of platform 1010 respectively. A turret 1014 is mounted on a positioning mechanism which is used to point turret 1014 in a desired direction as will be described below. Turret 1014 also includes a scanning assembly 1064. In platform 1010, lateral beams 1011*c,d* connect between the longitudinal beams 1011*a,b* to form the main frame of platform 1010.

Longitudinal beams 1011*a,b* house electric motors which drive three pairs of wheels 1017 to propel platform 1010. Alternatively, platform 1010 can be propelled on tracks. Longitudinal beams 1011*a,b* also house energy packs which supply power to platform 1010.

Figure 3:
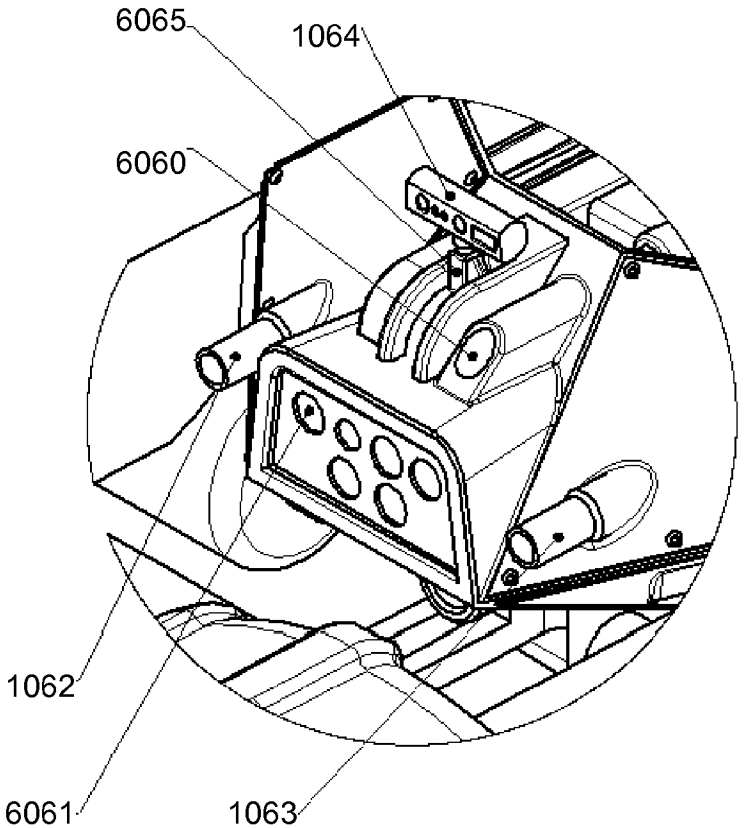
FIG. 3 schematically shows a perspective view of a preferred embodiment of some components in front of a turret.

In FIG. 1A, platform 1010 is shown in an operational mode in which turret 1014 is elevated by the positioning mechanism in order to provide a superior position for three synchronized factors (a high resolution imaging sensor [e.g., a high resolution video camera 6060—see FIG. 3], a target designator [e.g., a laser pointer 6061—see FIG. 3] and a weapon [e.g., a lethal rifle 1062 and a nonlethal rifle 1063—see FIG. 3] mounted on turret 1014. Turret 1014 is elevated by positioning mechanism using a front servo 1018*a* and a rear servo 1018*b* which push together the bases of elevation brackets 1020. The weapon incorporated into turret 1014 may be chosen according to the mission: nonlethal weapons may be for example, tear gas, pepper spray, an electric stunner, a robotic arm, sound waves, rifles, or guns with nonlethal ammunition, etc.

In FIG. 1A, turret 1014 is shown engaged with the driving interface of the robotic platform 1010. The turret 1014 including the three synchronized factors (high resolution imaging sensors, the target designator and the weapons or operational means), which are the operational means of robotic platform 1010 are all aligned in the preferred direction of travel (towards the front of platform 1010).

Turret 1014 also includes a scanning assembly 1064 which includes various sensors. Scanning assembly 1064 rotates to supply information on events all around platform 1010, thereby increasing situational awareness.

Figure 1B:
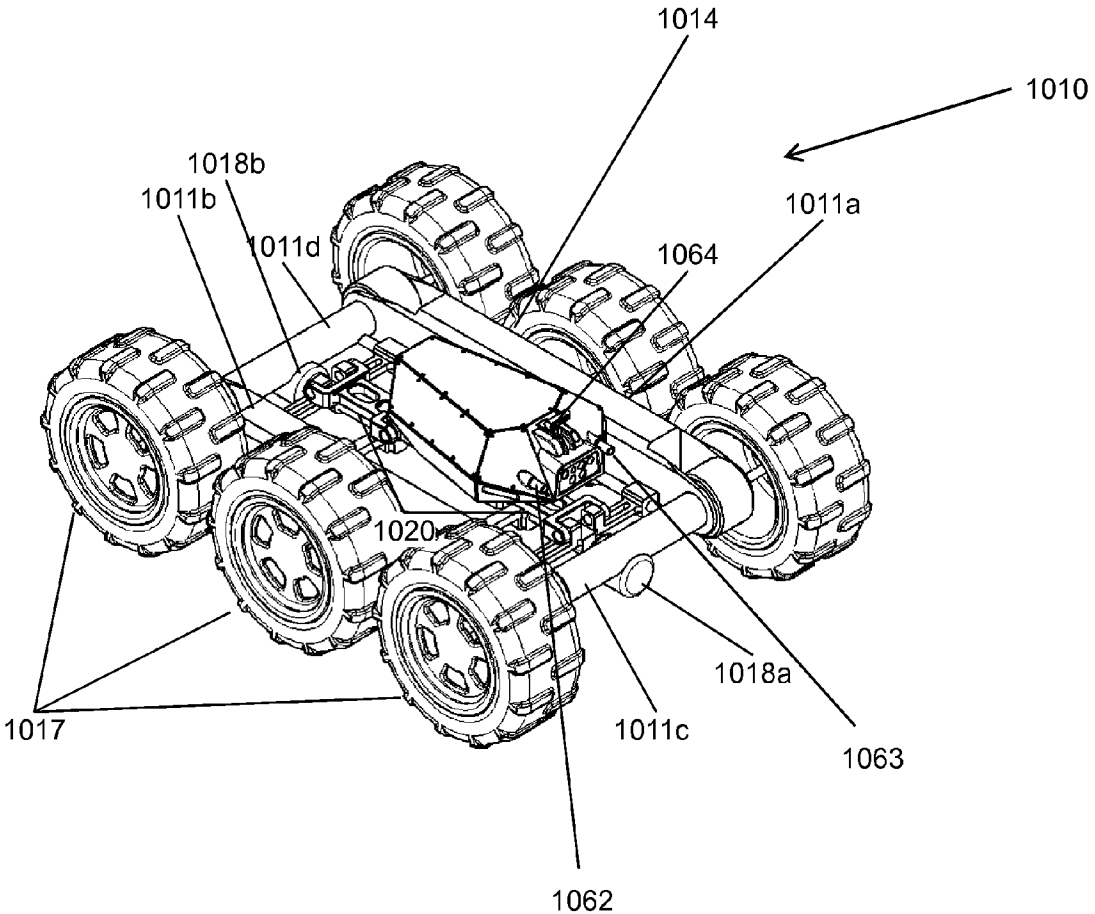
FIG. 1B schematically shows a perspective view of a preferred embodiment of the robotic platform in a stealth or stowing mode.

Thus, in this engaged mode, the high resolution imaging reconnaissance sensors provide the operator with an image of the scene in front of platform 1010 as is needed for driving. On the same image, a target marker is provided indicating the aim point of the operational means. In the engaged mode, the remote operator can aim the operational means at various targets by maneuvering platform 1010 using the driving interface until the marker is aligned to the target. In the engaged mode, the target marker always remains in the same position (at the center of the screen of the remote operator) and only the scenery on the screen changes, in accordance with the position of platform 1010. Engagement of driving and operational interfaces facilitates control of platform 1010 by a single remote operator (simultaneously driving platform 1010 and activating operational means). This engagement between the high resolution reconnaissance sensors, the target designator and the operational means is referred to herein as Three-Factor Dynamic Synchronization. FIG. 1B schematically shows a perspective view of platform 1010 in a stealth mode which is also useful for storage. In this mode, turret 1014 is lowered to reduce the profile of platform 1010 in order to improve its ability to operate without being detected. Because platform 1010 is electrically propelled, it operates relatively quietly. The stealth mode is useful for storing and transporting platform 1010 because in the stealth mode platform 1010 occupies minimal space.

Turret 1014 is lowered by the positioning mechanism by using front servo 1018*a* and rear servo 1018*b* to pull apart elevation brackets 1020.

Alternatively, platform 1010 may include towing hooks for fast connection to objects to be towed.

Platform 1010 is propelled by three pairs of wheels 1017 mounted to the main frame. In order to improve the traversability, the central pair of wheels 1017 is incorporated onto the main frame by a vertical track which gives a certain degree of vertical freedom to the central pair of wheels 1017 with respect to the front and rear wheels 1017. When platform 1010 traverses uneven ground, the central pair of wheels 1017 rise and fall to follow the terrain, increasing the overall contact surface between platform 1010 and the ground, in order to increase its traversability. Alternatively, a robotic platform may be supplied with tracks, rather than wheels 1017, for propulsion.

Figure 2:
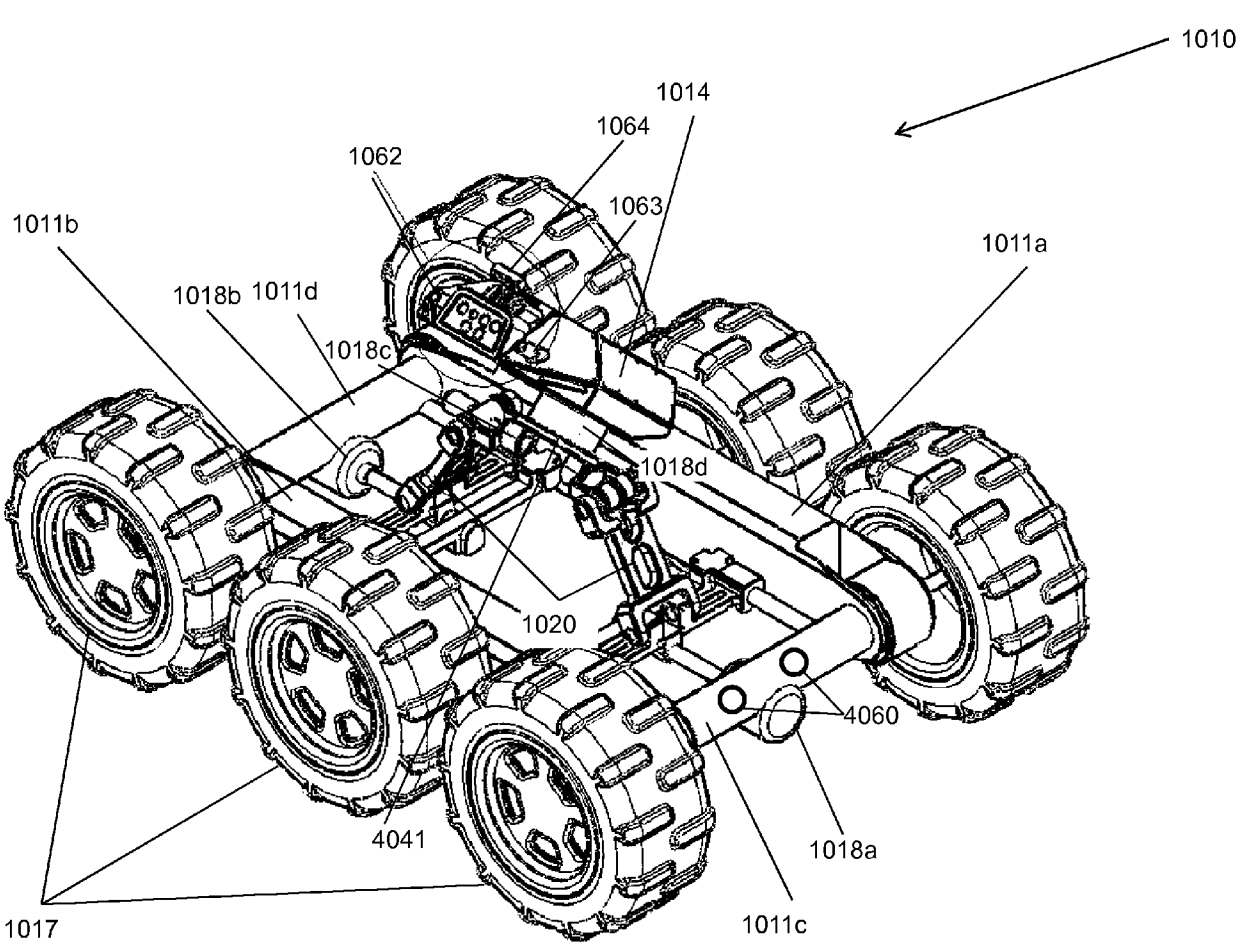
FIG. 2 schematically shows a perspective view of a preferred embodiment of the robotic platform in a disengaged operational mode.

FIG. 2 schematically shows a perspective view of robotic platform 1010 in a disengaged mode in which the positioning mechanism tilts turret 1014 towards a desired region of interest.

The positioning mechanism includes a servo 1018*c* responsible for the angle of vertical tilt of a plate 4041 on which turret 1014 is mounted. Servo 1018*c* can tilt plate 4041 upwards or downwards to direct reconnaissance sensors upward or downward. The positioning mechanism also allows turret 1014 to twist to a desired direction of interest, regardless of the direction in which platform 1010 is facing. This capability is achieved by incorporating a small servo 1018*d* onto plate 4041. Alternatively, the servo 1018*d* can be incorporated inside of turret 1014. The interface between turret 1014 and platform 1010 is via a slip ring (not shown) located between turret 1014 and plate 4041 in order to enable uninterrupted transfer of power and information between turret 1014 and the rest of platform 1010 while allowing turret 1014 to tilt and twist freely.

Also shown in FIG. 2 are dual video cameras 4060 mounded on beam 1011*c*. Cameras 4060 are dedicated to stereoscopic imaging of the preferred direction of travel of platform 1010 which is the region in front of platform 1010. Cameras 4060 provide a wide angle stereoscopic view of the region in front of platform 1010 while high resolution imaging sensors in turret 1014 give a detailed view of targets and distant objects.

An interface allows a remote operator to intuitively maneuver platform 1010. Particularly using cameras 4060, a viewing screen and dedicated glasses, the remote operator is provided with depth perception of the environment in front of platform 1010 as if he were driving a car and looking through its windshield. Binocular depth perception is intuitive, which means that the operator gets a concept of depth and distance in the operational scene using subconscious intellectual powers and does not need to divert his attention from other tasks in order to compute the distance to an object. Such capabilities are enhanced using various methods such as incorporating light emitting diodes to enable day and night driving capabilities, or by adding auxiliary sensors and detectors such as range finders, or additional imaging sensors to enlarge the field of view of the remote operator. Particularly, a wide screen presents both the view of the high resolution sensors inside turret 1014 and simultaneously presents the image caught by wide angle sensors 4060. Thus, the intuitive human awareness of the operator to motion in his peripheral vision serves to increase his awareness of the operational scene. Also inertial sensors (e.g., Fiber Optic Gyros) are provided in platform 1010. Based on the output of the inertial sensors, the image on the screen and a steering wheel may be tilted or shaken to give the operator a better intuitive sense of the attitude, directions and angles of platform 1010. Furthermore, inertial sensors record semi-reflexive or intuitive movements of the remote operator. According to these movements commands are sent to platform 1010. Also the wide integrated image on the screen takes advantage of the intuitive tracking nature of the human operator. Thus, the operator becomes aware of objects moving along the peripheral part of the screen and without requiring conscious effort he is prepared to react to objects that pass into the high resolution portion of the screen and into the field of attack of the weapon.

In FIG. 2, turret 1014 is in a disengaged mode. Thus operation interface of platform 1010 is not aligned with the driving interface which is directed in the preferred direction of travel. More specifically, the operational interface includes the three synchronized factors of turret 1014 and is directed in the direction of turret 1014 while the driving interface includes cameras 4060 which are directed in the preferred direction of travel. Generally, the remote operator of platform 1010 can choose whether to engage or disengage turret 1014 including high resolution reconnaissance sensors and the operational means to cameras 4060.

Platform 1010 is designed to allow operation by a single remote operator. Therefore, when turret 4014 is disengaged from the driving interface, the remote operator is responsible to simultaneously drive platform 1010 in one direction and operate high resolutions sensors and operational means in another direction. Even after providing physical means for the disengagement capability (which is the capability of turret 1014 including reconnaissance sensors, target designators and operational means to be directed in a direction other the direction of travel of platform 1010), such operation still remains a challenging and risky task. This challenge is detailed in the background of the invention and is called there "the control challenge." If the control challenge is not properly addressed, robotic platform 1010 may accidently crash or operational means may be inadvertently used to attack friendly targets.

In order to overcome the control challenge, one may employ two remote operators, each being in charge of different tasks associated with the operation of a platform (i.e., one operator can be in charge of driving and the other operator in charge of information gathering and combat). The drawback of such a solution is the need for double manpower and the need to synchronize both operators in order to maintain fluent operation of the robotic platform throughout the operation. This presents a great problem, especially in a combat situation, where, for example, soldiers in a tank are using robots for reconnaissance and cover. In such a situation, manpower, calm cooperation and presence of mind are a scarce resource.

Platform 1010 addresses the control challenge using two complementary technologies:

First, platform 1010 provides intuitive means for situational awareness to the remote operator. Intuitive awareness requires less attention from the operator and also takes advantage of instinctive and semiconscious awareness and actions of the operator, leaving his higher intellectual functions free for other, more complex tasks. One example of an intuitive means for situational awareness is supplying a stereoscopic imaging interface, described above (rather than, for example, a conventional screen and a digital rangefinder which supplies the same information as the stereoscopic image, but requires more concentration from the operator). Similarly, platform 1010 includes two directional microphones and supplies the operator with stereo sound from the operational scene. Thus, from the direction of the sounds, the remote operator (without further attention) has some awareness of the location of objects (not in his direct view) in the operational scene.

Secondly, platform 1010 includes processing capabilities and algorithms to perform certain tasks automatically or semi-automatically as described herein, below. Thus, the attention of the operator is freed for other tasks and he does not have to keep his awareness focused on the region where these tasks are being performed.

In order to simplify the operation of robotic platform 1010, especially in the disengaged mode, robotic platform 1010 includes a processor and algorithms to automatically or to semi-automatically execute certain tasks. Such tasks may be associated with: (i) reconnaissance, (ii) target acquisition and designation, (iii) operational means activation (iv) navigation (v) maneuvering, and (vi) combinations of the above tasks.

Tasks which are associated with reconnaissance can include, for example, the capture of information via sensors and detectors from predetermined regions of interest in the environment. The information captured by the sensors and detectors can be transmitted "as is" for further evaluation and analysis at the headquarters or the information can be processed by the internal processor of platform 1010 in order to serve as a trigger for sending alerts or for executing automatic tasks.

Tasks which are associated with target acquisition and designation may include running video motion detection software over the streaming video obtained by the imaging sensors, extracting a target from the streaming video, categorizing the target according to predefined criteria and sending an alert to the remote operator or designating turret 1014 towards the target in accordance with predefined criteria. Algorithms may be provided for estimating the level of threat from a target and advising the remote operator of further action.

Tasks which are associated with operational means activation may include the firing of nonlethal or lethal weapons towards targets identified according to predefined criteria. The predefined criteria may be extracted by accessories incorporated into platform 1010, such as noise detectors for automatic detection of the direction from which shots were fired. Generally, the identification will include multiple factors. For example, should a wide angle video camera recognize a flash of a missile launched and a microphone pick up a sound associated with the launch and at the same time the operator of platform 1010 or an operator of another friendly vehicle reports that a missile was launched against a friendly target, the processor of platform 1010 automatically directs fire using lethal rifle 6062 toward the missile launch site. Alternatively, fire may be directed at any missile launcher that is not identified as friendly using combat ID technology.

Tasks which are associated with driving may include navigation, maneuvering, overcoming obstacles, and automatically following a predetermined path. The navigation of platform 1010 can be based on a standard Global Positioning System (GPS) or on alternative navigation methods which are usually based on image processing and inertial sensors (such as Fiber Optic Gyros) and activated when GPS satellite reception is out of reach. The navigation of platform 1010 can be preprogrammed (e.g., according to standard GPS waypoint protocols, customized image processing etc.). Platform 1010 can be programmed to patrol a certain track repeatedly, or to automatically follow other forces such as vehicles, tanks soldiers, etc. In order to enable effective following, platform 1010 and the followed forces may be equipped with repeaters to ensure the specified forces are being followed. The use of such equipment to identify the fighting forces is sometimes referred to by the art as combat ID. This technology enables the remote operator to select the nature of the following assignment. For example, platform 1010 can be assigned to follow a tank at a distance of thirty meters and to respond automatically to threats which are detected behind the tank. In another example platform 1010 can be assigned to guard the tank by driving ahead of the tank at a distance of forty meters, automatically responding to threats in front of the tank.

The processor of platform 1010 is also programmed to recognize obstacles in its path and avoid or overcome them. Thus, platform 1010 can drive automatically even over rough terrain. Also the on-board processor is programmed with self-retaliation strategies. For example, in a semiautomatic mode, the operator can command platform 1010 to pursue a target while locking turret 1014 on the target. In another example: platform 1010 may be driven along a certain path while designating turret 1014 towards potential targets surrounding the path. Thus, platform 1010 protects itself from attack without the need to stop platform 1010. In yet another example, platform 1010 can function in an ambush mode in which platform 1010 is stationary and turret 1014 continuously scans a region of interest. Turret 1014 may also be automatically designated towards targets which are picked up by other sensors integrated into platform 1010.—For example, turret 1014 may be designated towards targets acquired by video motion detection firmware running on the output of imaging sensors 4060 and the designation of turret 1014 can be performed by pixel matching. Automation is necessary to allow a single operator to control all of these tasks.

Other than navigation from location A to location B, the robotic platform 1010 must be maneuvered within the operational scene in order to avoid obstacles and to respond to ongoing events. Tasks which are associated with maneuvering may include, for example, traversing obstacles that are detected along a path. Maneuvering is preferably controlled by the remote operator, who receives video streaming of environment around platform 1010. Such remote operation can be extended using stereoscopic imaging methods as detailed above and extrapolating the depth dimension of the scene, or by incorporating other standard sensors, systems or algorithms which are used to extract the depth dimension of the scene (e.g., acoustic sensors, laser, LADARs, etc.). Such maneuvering can be carried out in different operational modes such as manual operation, semi-automatic and automatic.

In the disengaged mode, the operator may manage the tasks of platform 1010 according to his preference. For instance, the remote operator may choose to maneuver platform 1010 manually using inputs provided by stereoscopic sensors 4060 and to direct turret 1014 towards targets automatically. Alternatively, the remote operator may choose to delegate both tasks to the processor of platform 1010 while overseeing platform 1010 and intervening when necessary. To better overcome the control challenge, the remote operator may adjust the presentation of information in the control interface. In an engaged mode, for example, the operator may choose two separate views: one view of the stereoscopic image provided by sensors 4060 for driving purposes, and the other view presenting a "zoom in" on the view in front of platform 1010 from the imaging sensors of turret 1014 to increase the situational awareness ahead and to provide a detailed view of the region towards which the weapons are directed by default. Alternatively, both views may be combined on the screen. In any of these examples, the target mark may be presented on either view as imaging sensor 4060 and turret 1014 are aligned. When platform 1010 is in disengaged mode, the operator may focus on the view provided by sensors 4060 while images of surrounding targets captured by turret 1014 will be presented as a separate view on the screen. The operator may designate turret 1014 to another direction by clicking on the image of a target in an image captured by any other sensor.

In an alternative embodiment, a second designator and a second weapon may be aligned to sensors 4060 such that the platform will include second set of synchronized factors (in addition to the synchronized factors in turret 1014), enabling designation of two targets simultaneously.

FIG. 3 schematically shows a perspective view of a preferred embodiment of some components of turret 1014.

In this preferred embodiment, the front of turret 1014 includes (for reconnaissance) a high resolution imaging sensor in the form of a high definition video camera 6060, a target designator in the form of a laser pointer 6061 and operational means in the form of lethal rifle 1062 and nonlethal rifle 1063. The sensor, the designator and weapons are all calibrated to facilitate simple operation of the system. From the remote operator's point of view, activation of the system is as simple as choosing a weapon, pointing and shooting. In other words, the remote operator can simply use a pointing device to select a target on a screen and turret 1014 will automatically direct itself towards the selected target such that laser pointer 6061 will designate the target and a weapon can then be fired towards that target by a press of a button. This simple interface is applied both in the engaged and the disengaged modes and shall be referred to herein as a "point-and-shoot interface." The point-and-shoot interface calculates the angle between the target mark and the selected target, then a processor converts the angle into maneuvering commands which are sent to platform 1010 in order to direct operational means toward the selected target. When turret 1014 is in engaged mode, lethal rifle 6062 is directed at a target by redirecting the entire platform 1010 towards the target. When turret 1014 is in disengaged mode, lethal rifle 6062 is directed at a target by redirecting just turret 1014 towards the target. A target mark or designator pinpoints the selected target and operational means are directed toward the selected target in accordance with the three factor synchronization method. A remote operator can select a target on a touch screen of the remote interface with his finger or the operator can select a target by means of a mouse and cursor, a keyboard or any other suitable interface. Alternatively, targets can be selected automatically using a video motion detection algorithm such that the remote operator will only need to decide whether to launch a weapon towards the selected target.

Scanning assembly 1064 is incorporated on top of turret 1014. Scanning assembly 1064 has a rotating mode to scan the surroundings and to transmit the captured information to the remote operator. Sensors on scanning assembly 1064 may vary from standard imaging means to radars and lasers at a variety of wavelengths in accordance with the necessity of the mission. An attitude adjustor 6065 maintains the scanning means horizontal to the ground, regardless to the angle of platform 1010. In this embodiment, a semi-automatic algorithm is used to direct turret 1014 towards targets which are detected by scanning assembly 1064. Scanning assembly 1064 may also be equipped with video cameras in order to provide alternative means to gather information for driving purposes. Rotating scanning assembly 1064 consumes less energy than rotating the entire turret 1014.

Scanning assembly 1064 is also used in a locked mode to keep track of particular objects. For example, when turret 1014 or all of platform 1010 is rotated, scanning assembly 1064 is locked onto a required region of interest or a selected target. Thus, in locked mode, scanning assembly 1064 helps the remote operator track targets during complex maneuvering. In rotating mode, scanning assembly 1064 helps the remote operator maintain some degree of awareness of the entire scene while concentrating on a particular task.

In this preferred embodiment, turret 1014 is modular, such that its internal components may be easily replaced. For example, the weapons may be exchanged, the sensors and detectors can be customized to the required mission, etc. In addition, the entire turret 1014 can also be replaced easily in order to suit ad hoc head assemblies to special assignments and to allow for quick repair and troubleshooting in the field or the laboratory. For example, at locations where there is a threat of Nuclear Biological or Chemical (NBC) warfare, a turret which includes (NBC) detectors can be chosen. Alternatively, a set of NBC detectors can be added to turret 1014 or incorporated into turret 1014 in place of other weapons.

In an alternative embodiment, energy packs and communication transceivers may be provided inside the turret. In platform 1010 turret 1014 relies on energy sources and communication transceivers which are mounted on the main frame and which communicate with turret 1014 via a slip ring interface. In a preferred embodiment, the main energy stacks are based on batteries installed inside or along the main frame due to volume and balance considerations. An additional energy pack may be carried or towed by the platform itself with a wagon, for example. Platform 1010 can be recharged by the replacement of the batteries or by connecting to an electric socket.

Figure 4:
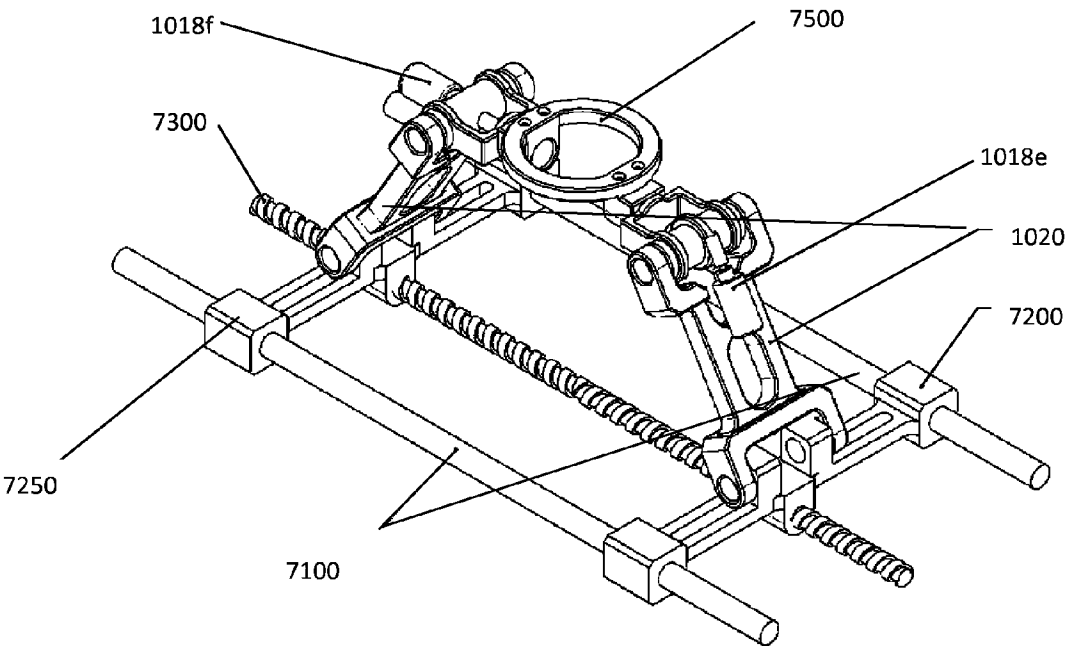
FIG. 4 schematically shows a perspective view of a preferred embodiment of a positioning mechanism.

FIG. 4 schematically shows a perspective view of a preferred embodiment of a positioning mechanism and of components which are associated with the positioning mechanism.

In this preferred embodiment, the positioning mechanism allows; (i) vertical movement by which turret 1014 may be elevated and lowered, (ii) twisting movement by which turret 1014 may be rotated, horizontally in either direction, (iii) tilting movement by which turret 1014 can be tilted up and down and (iv) rolling movement by which turret 1014 can be rolled to the sides.

In the embodiment of FIG. 4, the positioning mechanism includes two parallel rails 7100, a front trolley 7200 and a rear trolley 7250 which slide upon rails 7100. A screw 7300 draws the trolleys 7200 and 7250 towards each other to raise turret 1014. Elevation brackets 1020 are connected by hinges to front trolley 7200 and to rear trolley 7250 respectively. The upper parts elevation brackets 1020 are connected by hinges to the turret plate (4041 not shown) and slip ring 7500. A small servo 1018*e* connected to front elevation bracket 1020 activates a piston to push and pull the front bracket 1020 with respect to the back bracket 1020 in order to provide a tilting movement of the plate (4041 not shown), slip ring 7500 and turret 1014 mounted on top it, as shall be detailed. Another servo 1018*f* is responsible for rolling the plate (4041 not shown) and slip ring 7500 and turret 1014.

Figure 5:
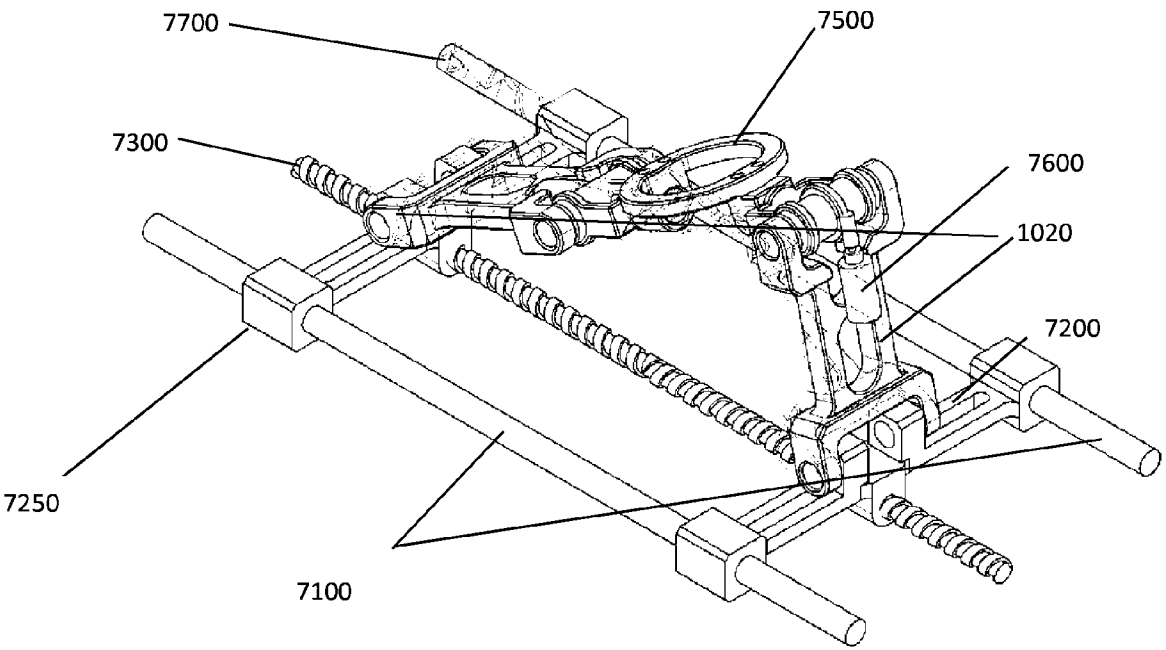
FIG. 5 schematically shows a perspective view of a preferred embodiment of a positioning mechanism capable of tilting the turret.

FIG. 5 schematically shows a perspective view of a preferred embodiment of a positioning mechanism capable of tilting turret 1014.

In this preferred embodiment servo 1018*e* applies pressure over the upper joint of front elevation bracket 1020 by actuating a twisting movement which is produced by pulling a wire in order to lift front elevation bracket 1020 with respect to rear elevation bracket 1020 and thus to tilt the turret plate (4041 not shown) and slip ring 7500 and turret 1014 which are connected between the upper joints of elevation brackets 1020.

Figure 6:
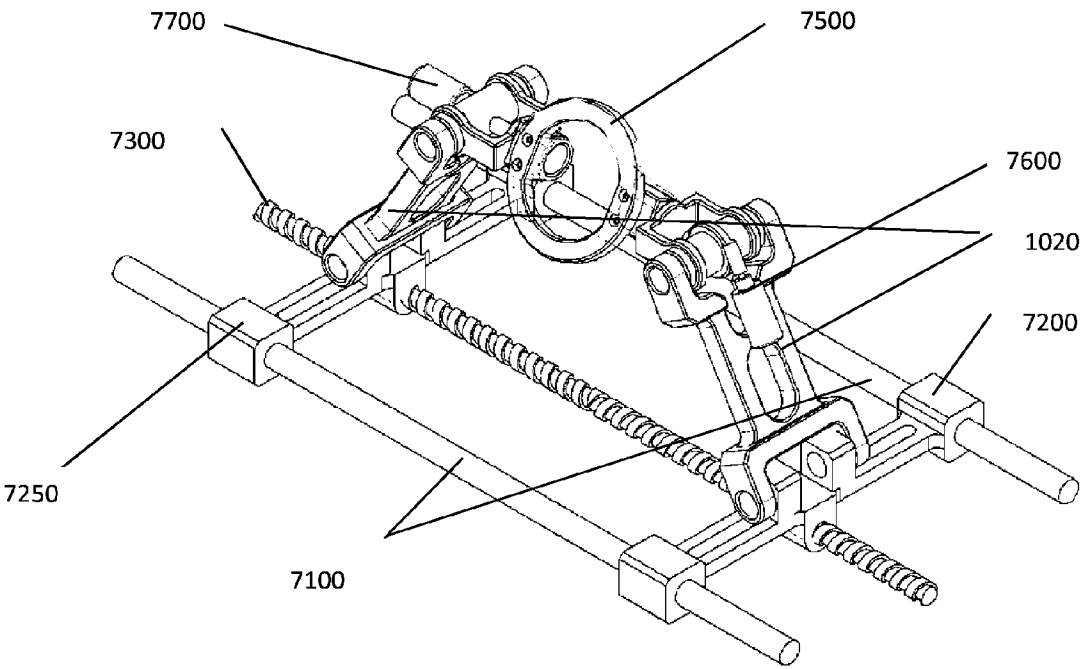
FIG. 6 schematically shows a perspective view of a preferred embodiment of a positioning mechanism capable of rolling the turret.

FIG. 6 schematically shows a perspective view of a preferred embodiment of a positioning mechanism capable of rolling turret 1014.

In this preferred embodiment, plate (4041 not shown) and slip ring 7500 and turret 1014 hang on a hinge which can be twisted by servo 1018*f* in order to roll plate (4041 not shown) and slip ring 7500 and turret 1014 to the desired position.

The positioning mechanism described in the drawings is merely an example of a positioning mechanism which is relatively simple to manufacture, reliable, and yet provides four different movement types to turret 1014. Servos 1018*a-f* described herein can be accompanied or replaced by different kinds of electric motors or other actuators, with or without hydraulic or pneumatic sub mechanisms and with or without gear in order to embody a specific positioning mechanism which suits the needs of the missions to be accomplished.

Figure 7A:
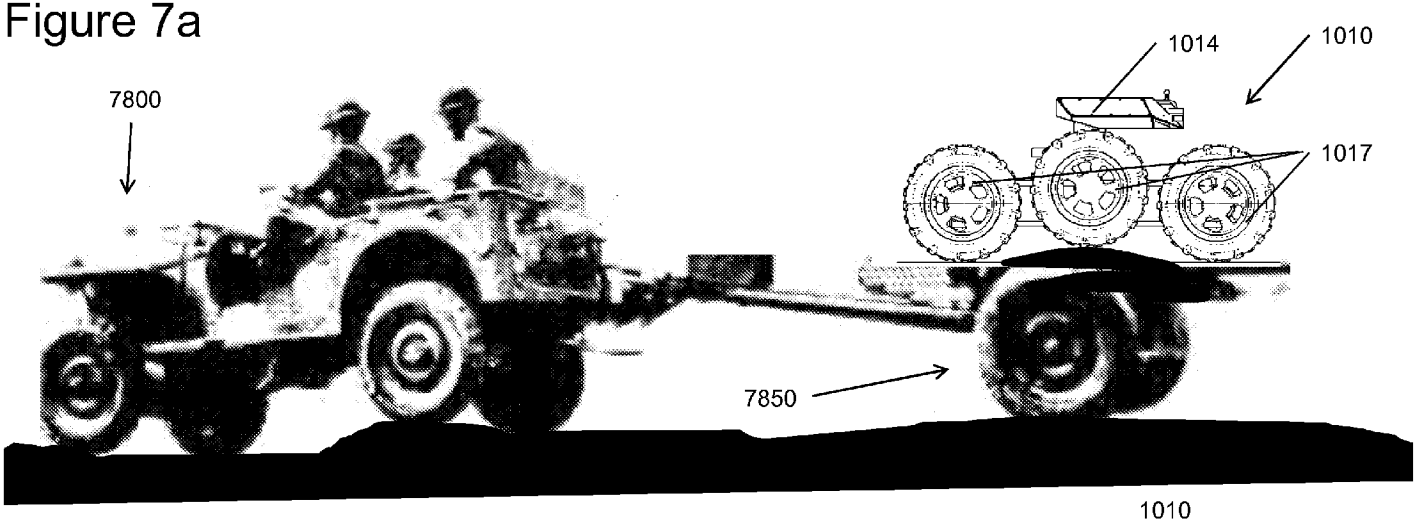
FIG. 7A schematically shows a perspective view of a preferred embodiment of a robotic platform covering the rear of a Jeep.

FIG. 7A schematically shows a perspective view of a preferred embodiment of platform 1010 covering the rear of a Jeep 7800.

In this preferred embodiment, platform 1010 is towed with a trailer 7850 while platform 1010 is in an operational mode. While platform 1010 is being towed platform 1010 scans the scene behind Jeep 7800, designates turret 1014 towards targets and alerts the remote operator of threats.

Figure 7B:
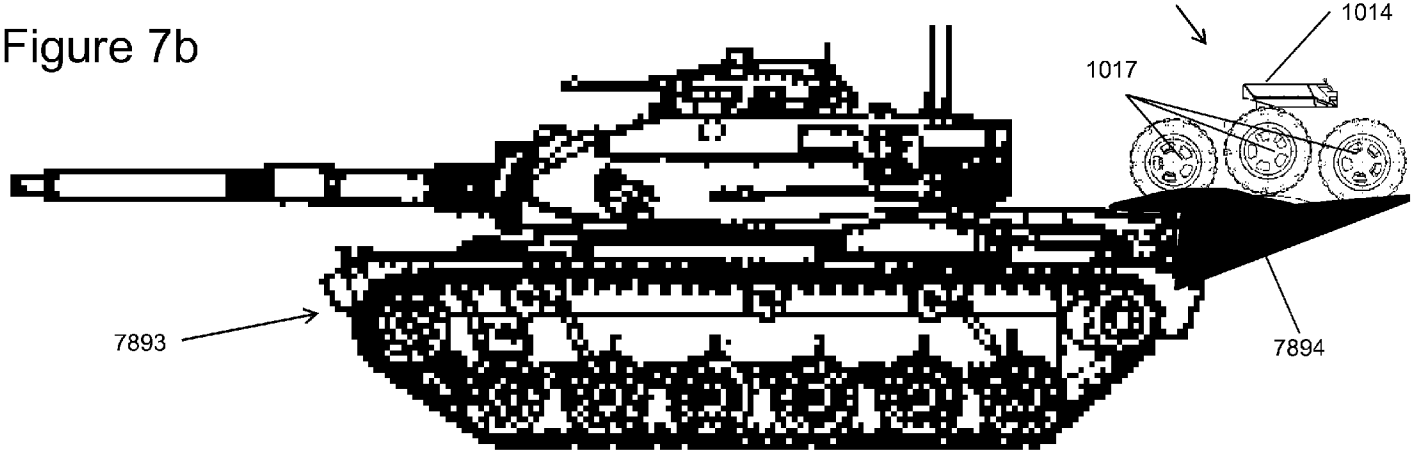
FIG. 7B schematically shows a perspective view of a preferred embodiment of a robotic platform covering the rear of a tank.

FIG. 7B schematically shows a perspective view of robotic platform 1010 covering the rear of a tank 7893.

In this preferred embodiment, robotic platform 1010 is being carried by a tank 7893 on a ramp 7894. Ramp 7894 hangs on a hinge to enable tilting of ramp 7894 to deploy robotic platform 1010 by driving platform 1010 off ramp 7894. Robotic platforms 1010 is programmed to cover the rear of tank 7893 while being transported. For example, platform 1010 responds to sudden threats by automatically locking turret 1014 on the threats and alerting the operator in tank 7893.

Platform 1010 includes programs enabling it to automatically follow tank 7893 after deployment and protect it from attack from the rear. Platform 1010 also includes programs for traveling ahead of tank 7893 according to commands of the remote operator and for acting as an advance guard. In addition, robotic platform 1010 can deploy dummies or other means of deception to confuse the enemy, and to withdraw the fire from tank 7893. In such a manner, tank 7893 and robotic platform 1010 operate as a team. Alternatively, platform 1010 may be configured so that a tank can carry multiple platforms. Thus, while being transported platforms 1010 protect the transport vehicle, respond to sudden threats and employ reconnaissance sensors to increase situational awareness. After deployment, the platforms act semi autonomously under control of operators (inside tank 7893 or elsewhere) to recognize and respond to threats to tank 7893. In such a manner, platforms 1010 operate in coordination with tank 7893 to protect tank 7893 and its crew and to enhance the effectiveness of tank 7893 in battle.

Figure 8:
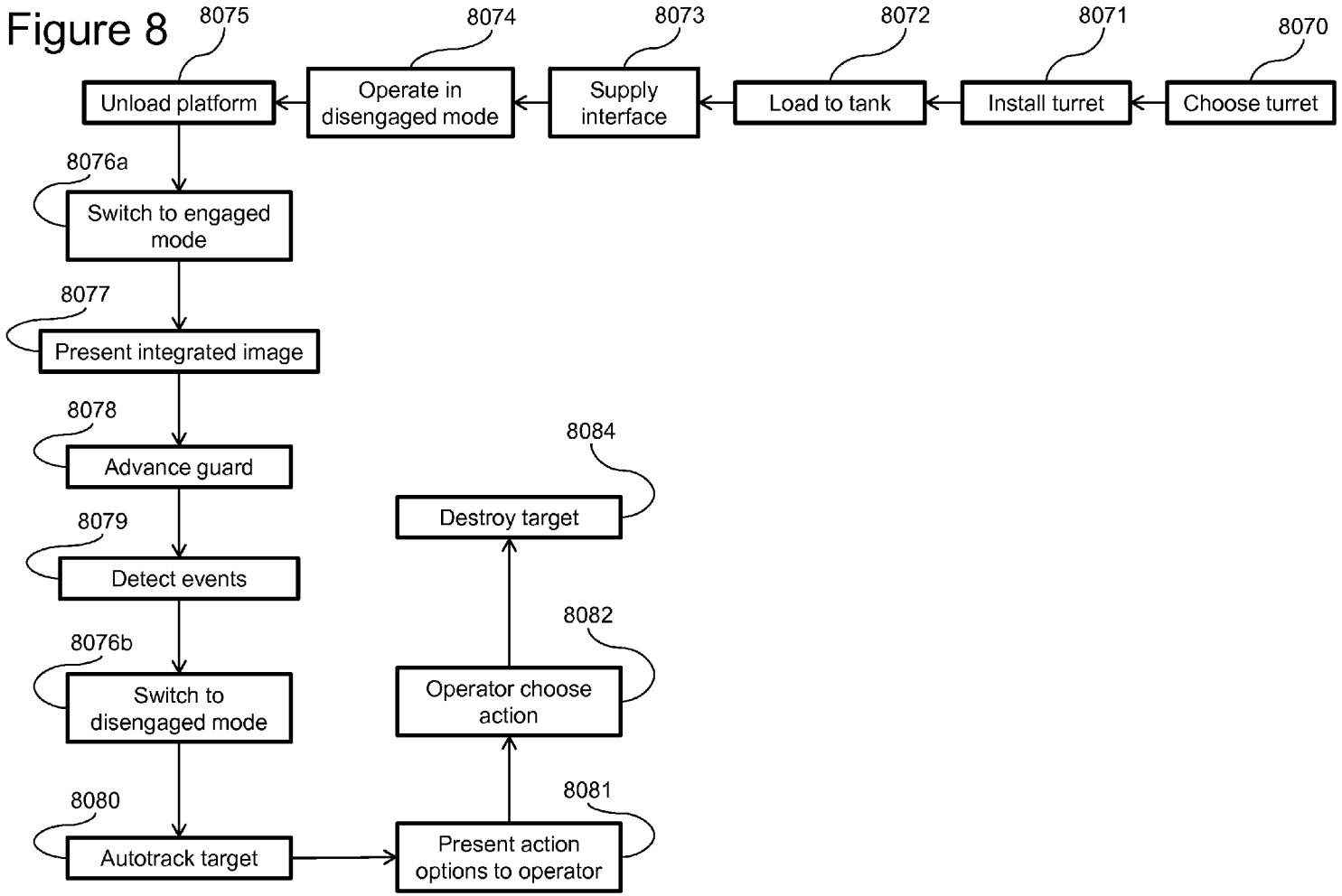
FIG. 8 is a flowchart of a method of multi-tasking a robotic platform by a single remote operator.

FIG. 8 is a flow chart illustrating a method of controlling robotic platform 1010 by a single human remote operator. First, platform 1010 is prepared for the mission by choosing 8070 a modular turret 1014 configured for the mission. For example, for a night mission in support of armor infiltrating into an urban area with irregular enemy troops, a modular turret 1014 including three synchronized factors: a sensor, which is a high resolution infrared (IR) imaging sensor (for example high definition infrared camera which is a high resolution FLIR), a designator (for example laser pointer 6061) and weapons, (for example lethal rifle 6062 and nonlethal rifle 6063) is chosen 8070 and installed 8071 onto platform 1010. Then platform 1010 is loaded 8072 onto tank 7893. Inside tank 7893 a single operator is supplied 8073 with a remote control interface to control platform 1010. For further missions under different conditions, turret 1014 can easily be exchanged for a turret including tear gas for crowd control or a high resolution video camera for daytime missions, etc.

While tank 7893 travels, the three synchronized factors operate 8074 in a disengaged mode. Particularly, scanning assembly 1064 is used to scan the area around tank 7893 while turret 1014 is pointed towards any suspicious activity in order to protect the rear of tank 7893. Thus, while platform 1010 is being transported, turret 1014 performs like an extra set of sensors and weapons to improve situational awareness and protect the rear of tank 7893.

Once the convoy reaches the battle field, platform 1010 is unloaded 8075 from tank 7893 and switched 8076*a* to engaged mode. In engaged mode, the high resolution imaging sensor of turret 1014 is pointed forward (in the preferred direction of travel of platform 1010) thus synchronizing the high resolution sensor of turret 1014 with low light video cameras 4060 of the driving interface of platform 1010. An integrated image is presented 8077 to the operator wherein a detailed high resolution IR image (from the high resolution FLIR on turret 1014) is integrated into the middle of a low resolution binocular video image (from video cameras 4060) of the region in front of and around platform 1010 (suitable for situational awareness and driving). Also integrated into the image is a crosshair marking the sight of aim of the target designator and weapons of turret 1014. Thus the remote operator can easily drive platform 1010 even at high speeds and acquire, site and destroy targets in front of platform 1010. The integrated image is configured such that while the focus of the attention of the remote operator is on the region directly ahead of platform 1010, the wider angle view of cameras 4060 is presented on the periphery. Thus the remote operator is made aware of events (such as movement) in the environment around platform 1010 using intuitive peripheral vision.

As the convoy enters a battle, platform 1010 travels ahead of tank 7893 as an advance guard 8078 clearing the area in order to protect tank 7893 from enemy soldiers that may carry shoulder fired anti-tank weapons. While the remote operator is driving platform 1010 ahead of tank 7893 sensors associated with scanning assembly 1064 are collecting reconnaissance information around platform 1010.

While platform 1010 is being driven in engaged mode, if the detectors of scanning assembly 1064 detect 8079 movement, a threat, or other important events around platform 1010, the on-board processor automatically switches 8076*b* platform to disengaged mode and directs turret 1014 towards the source of the action. Thus, the high resolution imaging sensor is directed to the target and the output of the high resolution imaging sensor is removed from the main screen (since the high resolution IR camera is no longer engaged to video cameras 4060, high resolution image is no longer integrated into the image of cameras 4060) and shown to the remote operator as a separate view on the screen or on a separate screen. While the operator continues to drive platform 1010 based on the image displayed to him from cameras 4060, the processor automatically tracks the target with turret 1014 and presents action options 8081 to the remote operator. For example, if the target appears to be threatening platform 1010 or tank 7893, onboard processor suggests to the remote operator either to attack the target, take evasive action, or flee. The operator selects 8082 an action, for example attacking the target. The computer then automatically activates its main gun, destroying 8084 the target.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A robotic platform having a main frame and comprising:

a) a first imaging sensor directed in a preferred direction of travel;

b) synchronized factors rotatably mounted to the main frame, wherein said synchronized factors include a second imaging sensor, a target designator and a weapon, and c) a remote control interface configured for control by a single human operator;

wherein said synchronized factors are configured for switching between two modes, i) an engaged mode wherein said synchronized factors are aligned to said first imaging sensor, and ii) a disengaged mode wherein said synchronized factors rotate independently of said first imaging sensor.

2. The robotic platform of claim 1, further comprising d) a processor configured for performing a task automatically when said synchronized factors are in said disengaged mode.

3. The robotic platform of claim 2, wherein said task includes at least one action selected from the group consisting of detecting a motion, locking on a target, tracking a target, approaching a target, warning said single human operator of a need for attention, driving the robotic platform, overcoming an obstacle, following a target, retreating from a target, evading a threat and acting in support of a friendly combat unit.

4. The robotic platform of claim 1, wherein said first imaging sensor is synchronized to a second target designator and to a second weapon.

5. The robotic platform of claim 1, wherein said first imaging sensor is configured for reconnaissance in front of the robotic platform while the robotic platform is in said disengaged mode.

6. The robotic platform of claim 1, wherein said synchronized factors are configured to function in said disengaged mode for supplying information on events occurring around a vehicle while the robotic platform is being transported by said vehicle.

7. The robotic platform of claim 1, wherein said remote control interface is configured to utilize an intuitive power of said single human operator.

8. The robotic platform of claim 7, wherein said intuitive power includes at least one ability selected from the group consisting of binocular depth perception, peripheral motion detection, and stereo audio perception.

9. The robotic platform of claim 1, wherein said synchronized factors are mounted to an interchangeable modular assembly.

10. The robotic platform of claim 1, wherein said remote control interface is configured to present to said single human operator an integrated image including an image captured by said first imaging sensor and another image captured by said second imaging sensor.

11. The robotic platform of claim 1, wherein said switching is performed automatically.

12. The robotic platform of claim 11, wherein said switching is performed in reaction to at least one event selected from the group consisting of detecting a movement in an environment around the robotic platform, detecting an attack and detecting a sound.

13. The robotic platform of claim 1, wherein said switching includes at least one action selected from the group consisting of directing said synchronized factors toward a target, designating a target, and activating said weapon towards a target.

14. The robotic platform of claim 1, further comprising:

d) a turret and wherein said synchronized factors are mounted to said turret.

15. A method for a single human operator to control a robotic platform having a main frame comprising:

a) acquiring a first image from a first imaging sensor directed in a preferred direction of travel;

b) providing a remote control interface configured for control by a single human operator;

c) switching said synchronized factors from an engaged mode wherein said synchronized factors are aligned to said first imaging sensor to a disengaged mode wherein said synchronized factors rotate independently of said first imaging sensor, and d) directing synchronized factors towards a target wherein said synchronized factors include a rotationally mounted second imaging sensor, a target designator and a weapon.

16. The method of claim 15, further comprising:

e) performing a task automatically when said synchronized factors are in said disengaged mode.

17. The method of claim 16, wherein said task includes at least one action selected from the group consisting of; detecting a motion, tracking a target, locking on a target, warning the single human operator of a need for attention, driving the robotic platform, overcoming an obstacle, following a target, approaching a target, retreating from a target, avoiding a threat and acting in support of a friendly combat unit.

18. The method of claim 15, further comprising e) synchronizing said first imaging sensor to a second target designator and to a second weapon.

19. The method of claim 15, further comprising e) supplying information on events occurring in an environment around a vehicle while the robotic platform is being transported by said vehicle using said second imaging sensor in said disengaged mode.

20. The method of claim 15, further comprising:

e) utilizing an intuitive power of said single human operator.

21. The method of claim 20, wherein said intuitive power includes at least one ability selected from the group consisting of binocular depth perception, peripheral motion detection and stereo sound perception.

22. The method of claim 15, further comprising:

e) changing a modular assembly including said synchronized factors.

23. The method of claim 15, further comprising:

e) presenting to said single human operator an integrated image including an image captured by said first imaging sensor and another image captured by said second imaging sensor.

24. The method of claim 15, wherein said switching is performed automatically.

25. The method of claim 15, wherein said switching is performed in reaction to at least one event selected from the group consisting of detecting a movement in an environment around the robotic platform, detecting an attack and detecting a sound.

* * * * *